US012392264B2

(12) United States Patent
Patankar et al.

(10) Patent No.: US 12,392,264 B2
(45) Date of Patent: Aug. 19, 2025

(54) LIFTER ASSEMBLY

(71) Applicant: Eaton Intelligent Power Limited, Dublin (IE)

(72) Inventors: Vardhan D. Patankar, Pune (IN); Tapan Ponkshe, Pune (IN); Sanjay Chopane, Pune (IN); Jiri Cecrle, Prague (CZ); Nicola Andrisani, Turin (IT)

(73) Assignee: Eaton Intelligent Power Limited, Dublin (IE)

( * ) Notice: Subject to any disclaimer, the term of this patent is extended or adjusted under 35 U.S.C. 154(b) by 44 days.

(21) Appl. No.: 17/771,319

(22) PCT Filed: Oct. 22, 2020

(86) PCT No.: PCT/EP2020/025471
§ 371 (c)(1),
(2) Date: Apr. 22, 2022

(87) PCT Pub. No.: WO2021/078413
PCT Pub. Date: Apr. 29, 2021

(65) Prior Publication Data

US 2022/0349321 A1 Nov. 3, 2022

(30) Foreign Application Priority Data

Oct. 22, 2019 (IN) ..... 201911042844

(51) Int. Cl.
*F01L 1/14* (2006.01)
*F01L 13/00* (2006.01)
*F01L 1/46* (2006.01)

(52) U.S. Cl.
CPC ..... *F01L 1/14* (2013.01); *F01L 13/0036* (2013.01); *F01L 2001/467* (2013.01); *F01L 2305/00* (2020.05); *F01L 2810/02* (2013.01)

(58) Field of Classification Search
CPC ..... F01L 2305/00; F01L 2001/467; F01L 2810/02; F01L 1/14; F01L 1/08;
(Continued)

(56) References Cited

U.S. PATENT DOCUMENTS 1,500,556 A * 7/1924 Goodwin ..... F01L 1/12 123/90.49
5,673,661 A * 10/1997 Jesel ..... F01L 1/14 123/90.48

(Continued)

FOREIGN PATENT DOCUMENTS

DE 10120448 A1 * 10/2002 ..... F01L 1/022
DE 102006034624 A1 1/2008

(Continued)

OTHER PUBLICATIONS

International Search Report and Written Opinion for PCT/EP2020/025471; mailed Feb. 10, 2021; pp. 1-12.

(Continued)

*Primary Examiner* — Mark A Laurenzi
*Assistant Examiner* — Kelsey L Stanek
(74) *Attorney, Agent, or Firm* — Baker Botts L.L.P.

(57) ABSTRACT

A lifter assembly can comprise an outer body comprising an oil port and opposed latch ports. An inner body can comprise a roller assembly or tappet configured to lift and lower to follow a cam. The inner body comprises a pin passage comprising an inner diameter. A pin assembly is mounted in the pin passage. The pin assembly comprises a bushing abutting the inner diameter. The bushing comprises a pin port. A pin comprises a rim and a narrow end configured for sliding in the pin port.

14 Claims, 8 Drawing Sheets

(58) Field of Classification Search
CPC ..... F01L 1/46; F01L 13/00; F01L 13/0036; F01L 13/0005
USPC ..... 123/90.48
See application file for complete search history.

(56) References Cited

U.S. PATENT DOCUMENTS

| | | | | |
|---|---|---|---|---|
| 5,992,360 | A | 11/1999 | Elendt et al. | |
| 6,076,491 | A * | 6/2000 | Allen | F01L 13/0005 123/90.55 |
| 6,223,706 | B1 * | 5/2001 | Maas | F01L 13/0036 123/90.48 |
| 2003/0101953 | A1 | 6/2003 | Hendriksma et al. | |
| 2004/0144350 | A1 * | 7/2004 | Artmann | F01L 1/143 123/90.53 |
| 2015/0101562 | A1 * | 4/2015 | Choi | F01L 13/0005 123/198 F |
| 2020/0123939 | A1 | 4/2020 | Sarati | |
| 2020/0325800 | A1 | 10/2020 | McCarthy, Jr. et al. | |
| 2021/0079817 | A1 | 3/2021 | Jensen et al. | |

FOREIGN PATENT DOCUMENTS

| | | | | |
|---|---|---|---|---|
| DE | 102008031295 | A1 | 1/2009 | |
| EP | 2653674 | A1 | 10/2013 | |
| WO | WO-2009013104 | A1 * | 1/2009 | F01L 1/143 |
| WO | 2019008445 | A1 | 1/2019 | |

OTHER PUBLICATIONS

CN OA for Chinese Application No. 202080068993.8, mailed on Apr. 15, 2023, 17 pages.

* cited by examiner

LIFTER ASSEMBLY

This is a United States § 371 National Stage Application of PCT/EP2020/025471 filed Oct. 22, 2020 and claims the benefit of Indian provisional application 20/1911042844 filed Oct. 22, 2019, all of which are incorporated herein by reference.

FIELD

This application provides a lifter assembly and pin assembly.

BACKGROUND

Engines can be designed to lift and lower valves in a valvetrain by installing a lifter assembly in the engine block and by rotating a cam formed with one or more lift profiles. Challenges exist for fast actuation and oil control.

SUMMARY

The methods and devices disclosed herein improve the art by way of a lifter assembly comprising an outer body comprising an oil port and opposed latch ports. An inner body can comprise a roller assembly or tappet configured to lift and lower to follow a cam. The inner body comprises a pin passage comprising an inner diameter. A pin assembly is mounted in the pin passage. The pin assembly comprises a bushing abutting the inner diameter. The bushing comprises a pin port. A pin comprises a rim and a narrow end configured for sliding in the pin port.

A pin assembly can be configured for mounting in a pin passage. The pin assembly comprises a bushing for abutting an inner diameter of the pin passage. The bushing comprises a pin port. A pin comprises a rim and a narrow end configured for sliding in the pin port.

The bushing can be pressed to a stepped inner diameter of the inner body. Then, the rim can slide against the inner diameter.

In another alternative, the inner body can comprise a slot, and the bushing can comprise a recess. A stake can span a portion of the slot and into the recess. The slot can form a fluid leak-down path. Or, the bushing can further comprise a fluid leak-down path. Or, the stake can comprise a fluid leak-down path.

The bushing can alternatively comprise a step and a bore in a tubular structure configured so that the rim is guided within the bore and is limited by the step. The bushing can comprise an end wall comprising the pin port. The end wall can comprise a spring seating area. The pin assembly comprises a spring biased against the spring seating area and the rim. The pin assembly can be biased so that the pin is retracted away from the latch ports. The lifter assembly and pin assembly can be configured so that the inner body further comprises a stop pin bore intersecting the pin passage. A stop pin can be installed in the stop pin bore with the stop pin configured to limit the travel of the pin. The bushing can also be configured with an oil slot to fluidly communicate with the oil passage.

The pin port and the narrow end can be keyed in an anti-rotation configuration. An anti-rotation groove can alternatively be formed in an external diameter of the bushing and a rod bore can be formed through the inner body and can intersect the pin passage. Then, an anti-rotation rod can be seated in the anti-rotation groove and in the rod bore.

In another alternative, the inner body can further comprise a follower anti-rotation bore. The outer body can further comprise a follower anti-rotation slot. A follower anti-rotation rod can be seated to extend out of the follower anti-rotation bore into the follower anti-rotation slot. The follower anti-rotation bore can pass through the inner body. And, the anti-rotation rod can pass through the inner body completely and extends out into a second follower anti-rotation slot.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DETAILED DESCRIPTION

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures.

Figure 1A:
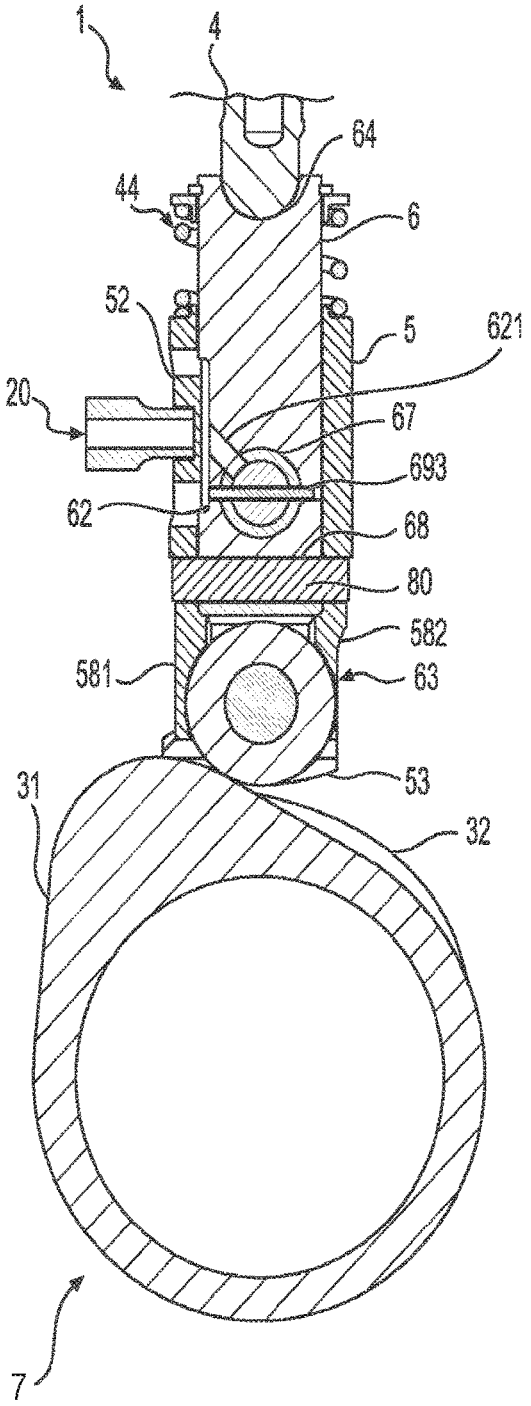
FIGS. 1A & 1B show a lifter assembly and a pin assembly.
Figure 1B:
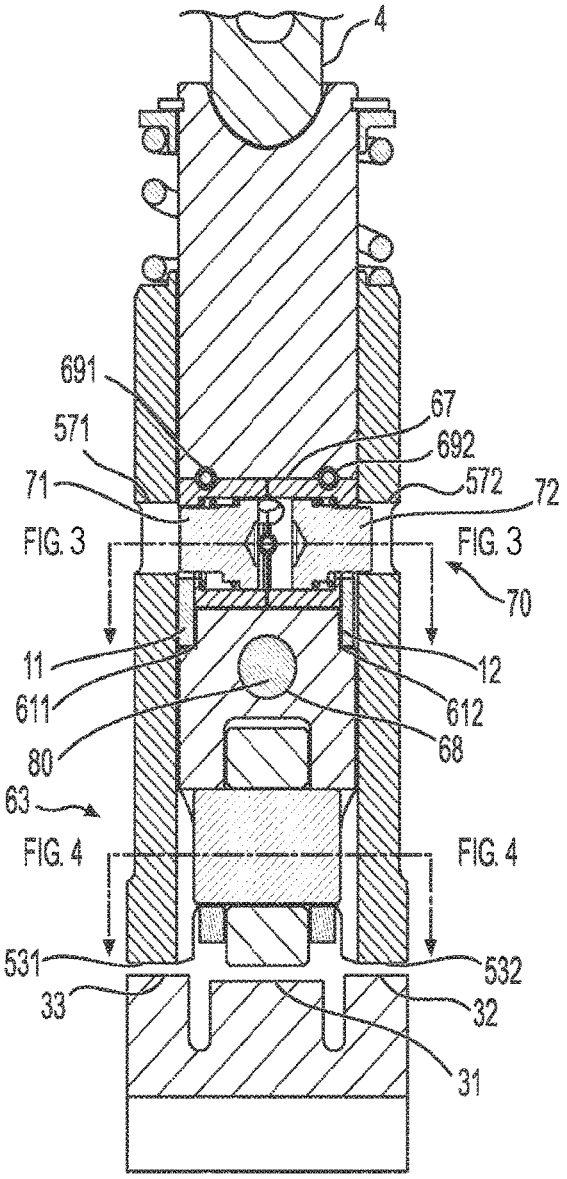
Figure 2:
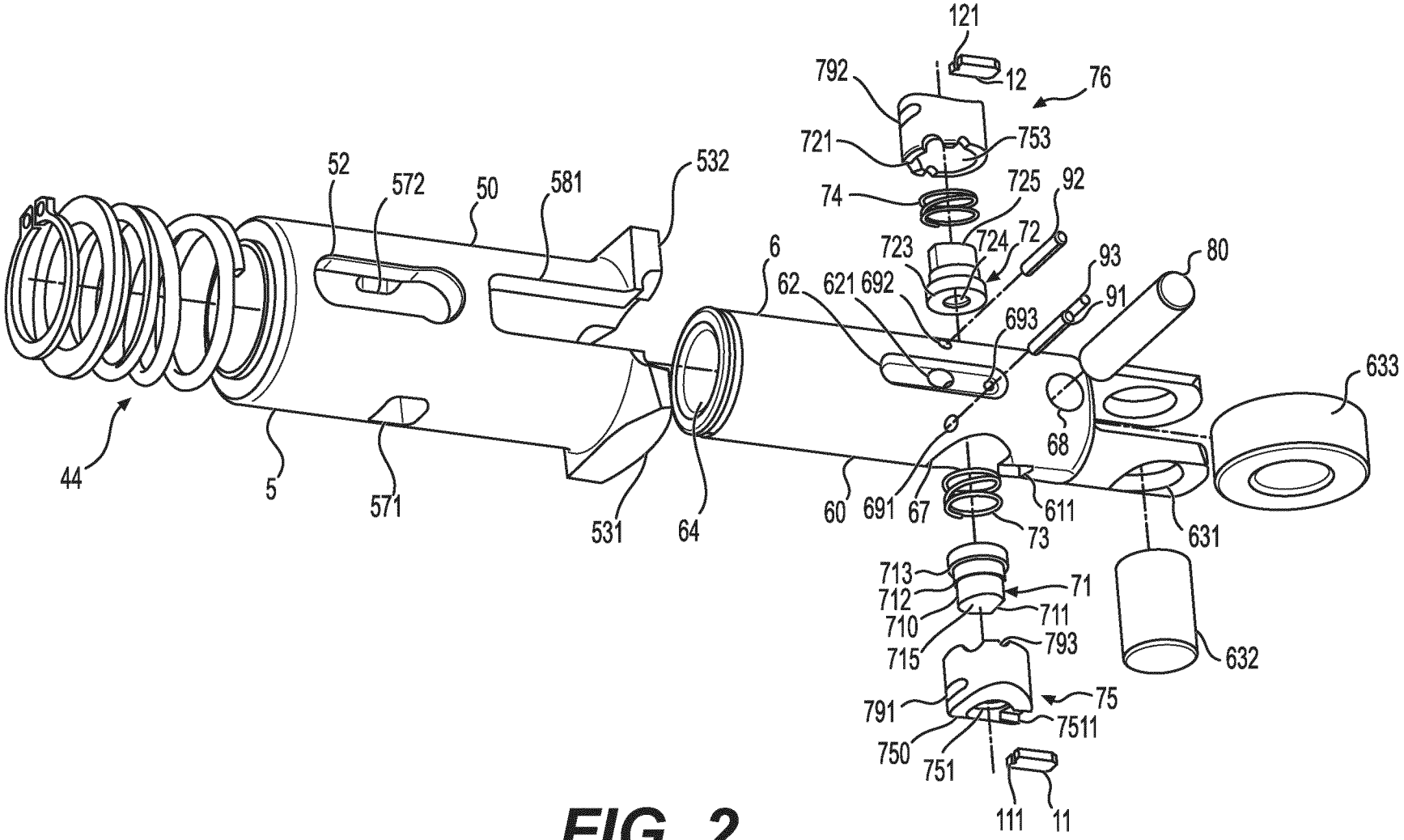
FIG. 2 is an exploded view of a lifter assembly and a pin assembly.
Figure 4:
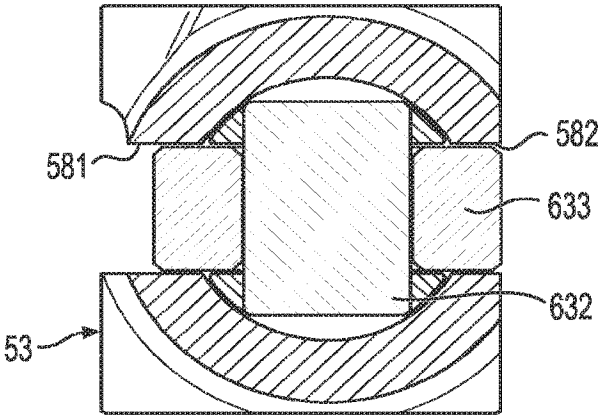
FIG. 4 is a view of a bearing assembly configured to oppose twist relative to the outer body.
Figure 3:
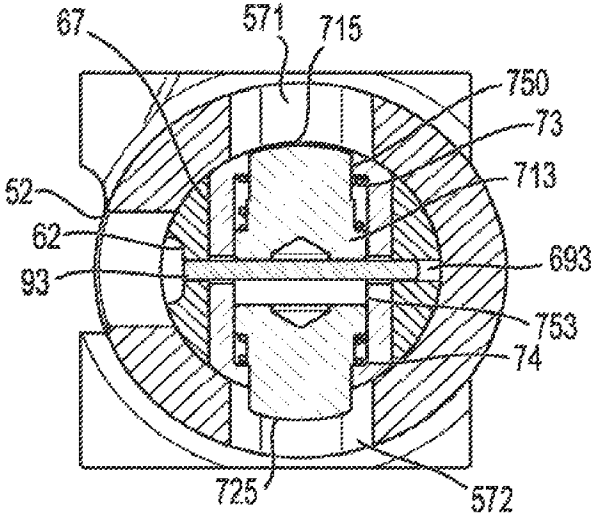
FIG. 3 is a view of a stop pin and pin travel. The pin assembly is shown with one pin latched and one pin unlatched in FIGS. 1B & 3.
Figure 5:
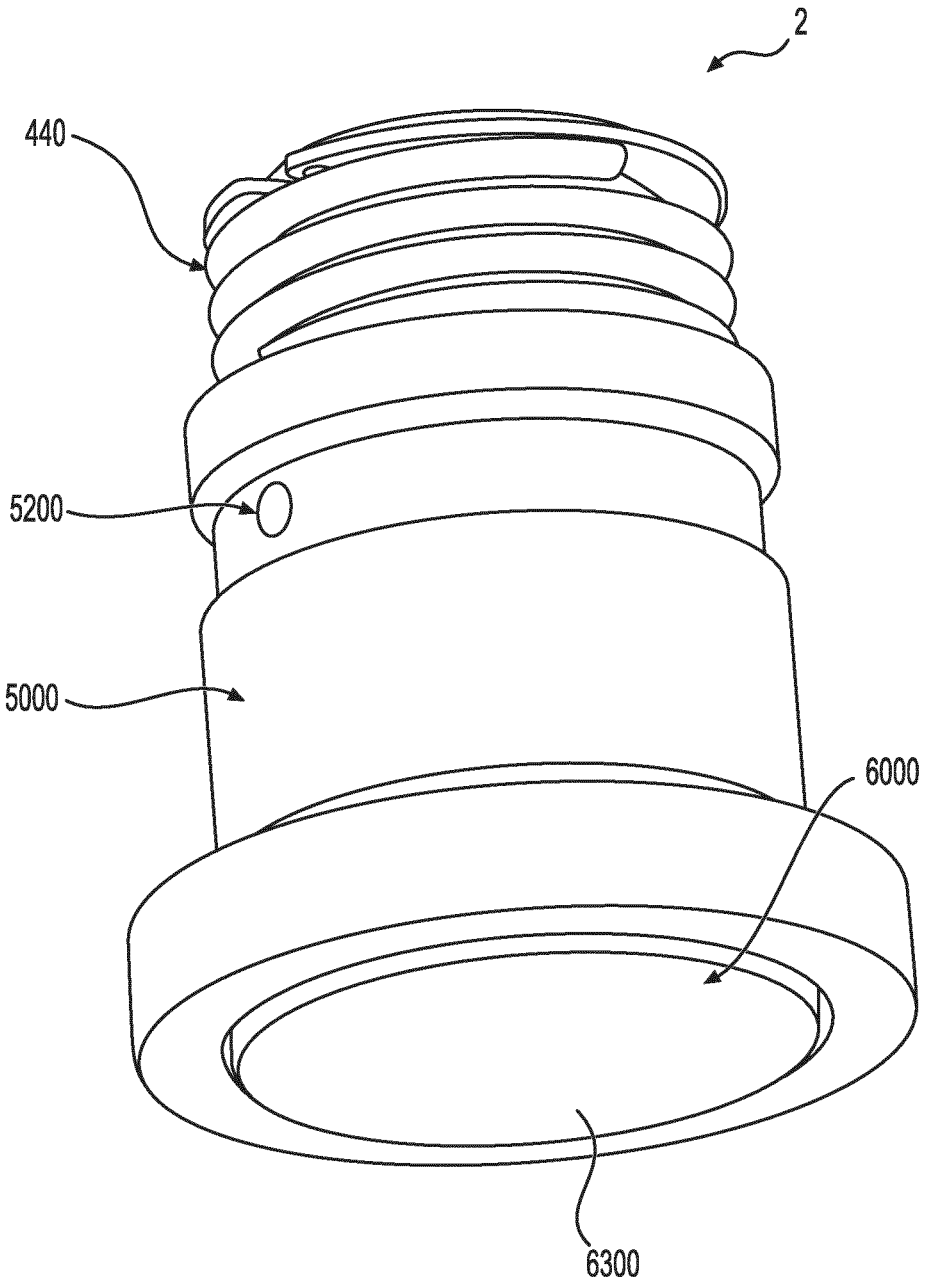
FIGS. 5-7 are views of an alternative lifter assembly and alternative pin assembly.
Figure 6C:
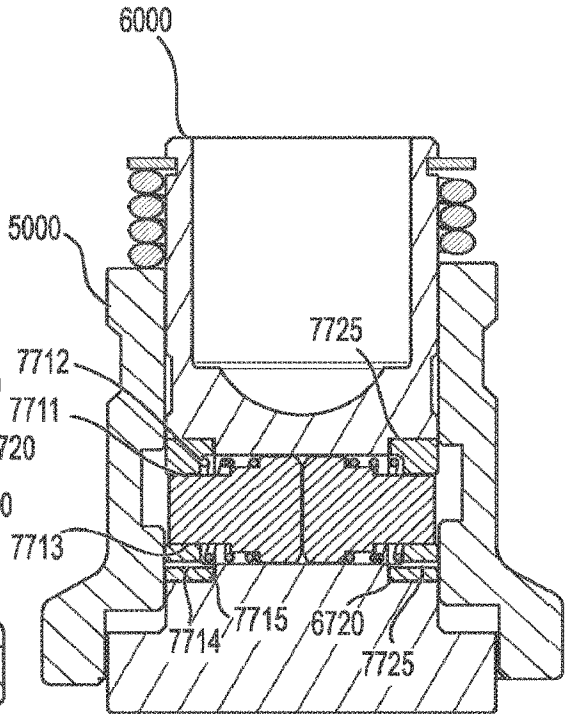
Figure 6B:
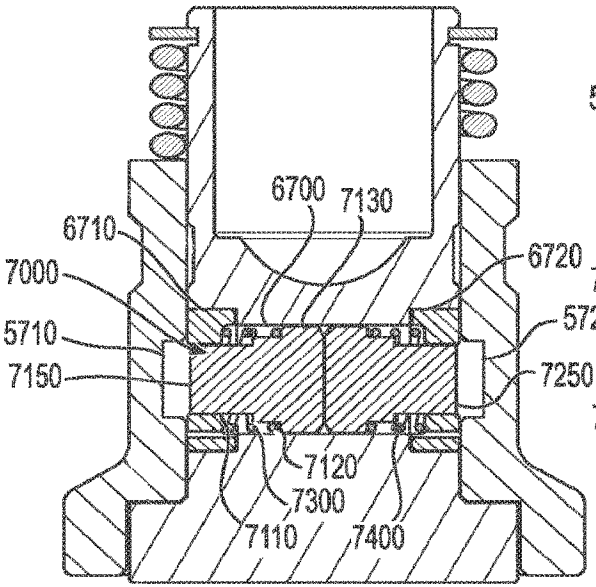
Figure 6A:
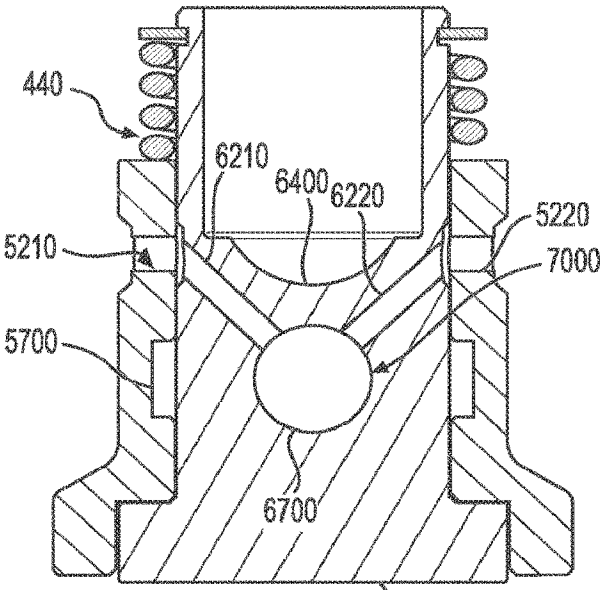
Figure 7:
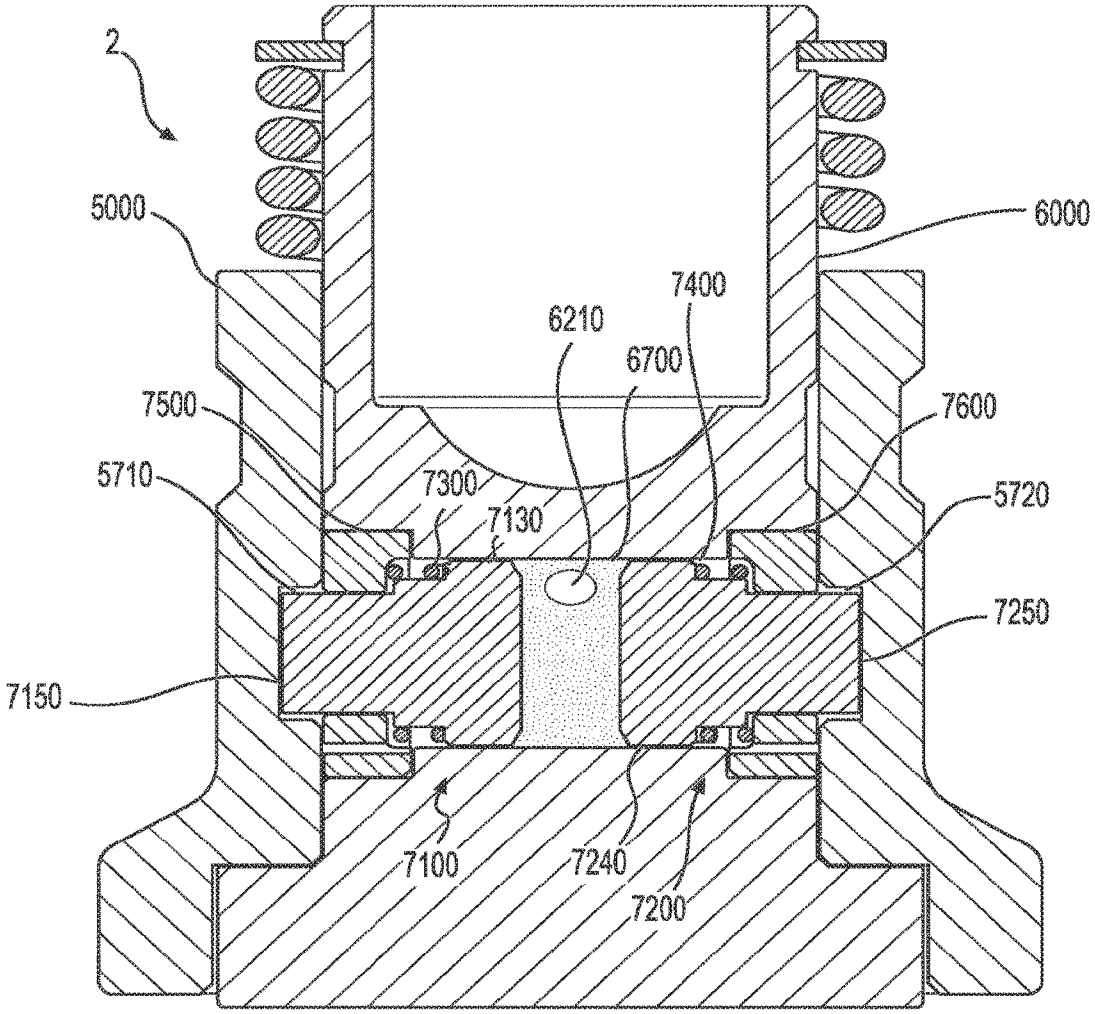
Figure 8A:
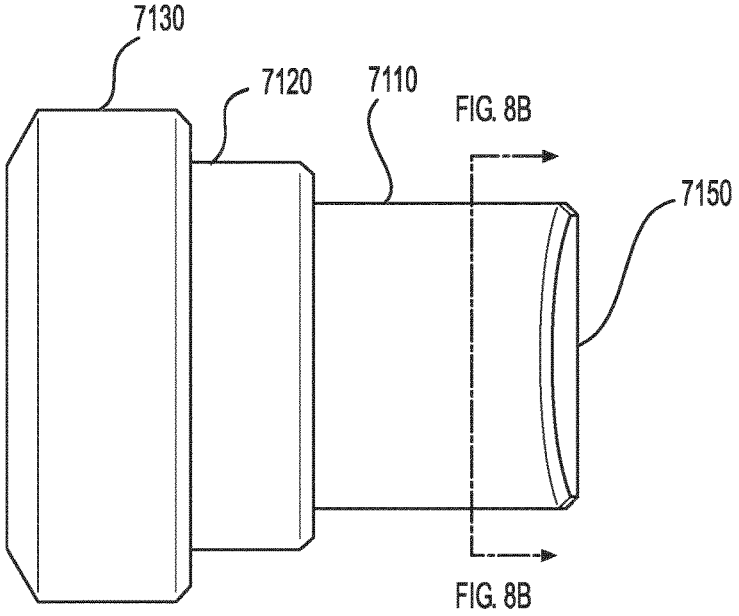
FIGS. 8A & 8B are views of a pin.
Figure 8B:
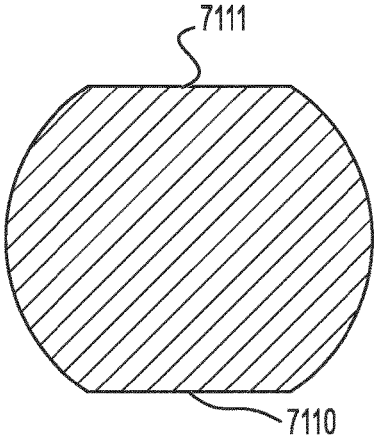
Figure 9A:
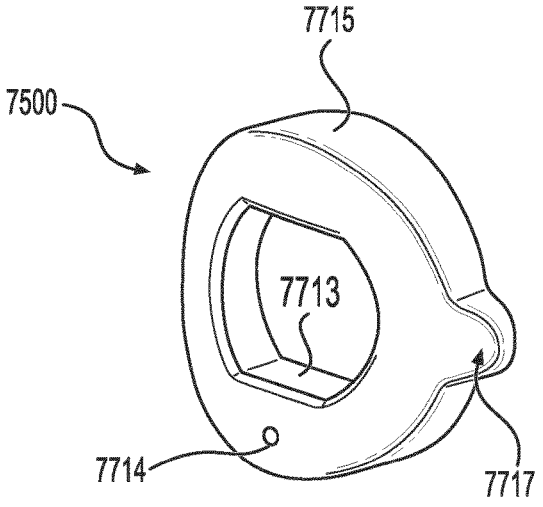
FIGS. 9A & 9B are views of an alternative bushing.
Figure 9B:
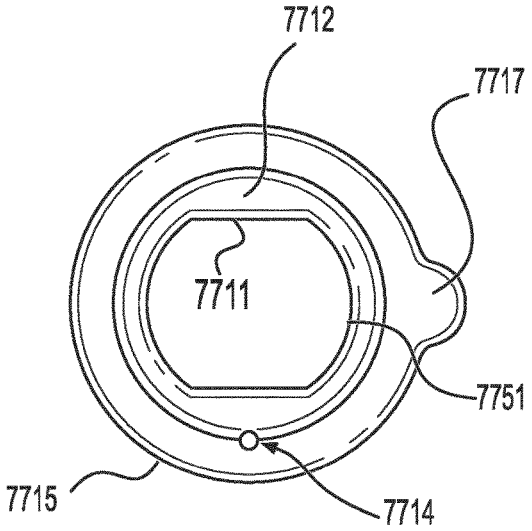
Figure 10A:
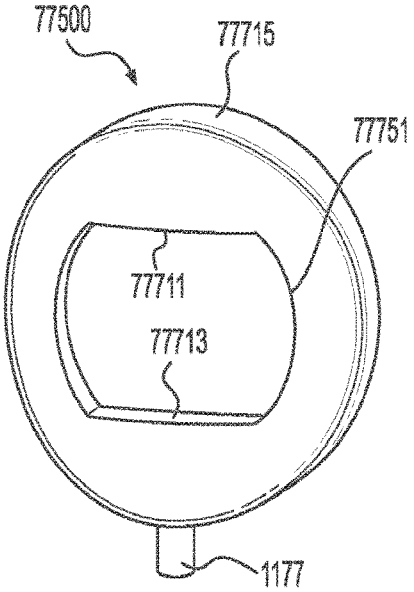
FIGS. 10A & 10B are views of another alternative bushing.
Figure 10B:
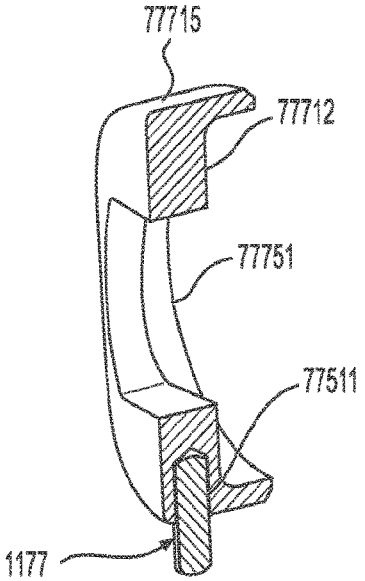
Figure 11A:
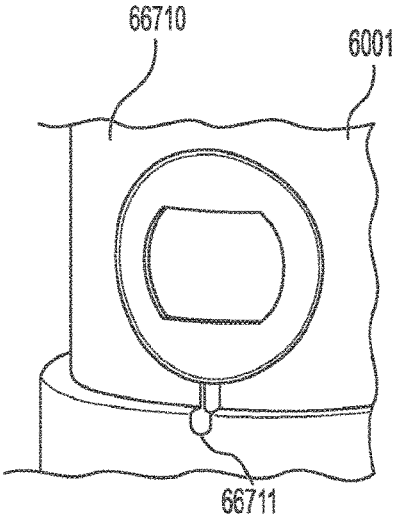
FIGS. 11A & 11B are views of an alternative lifter assembly with an alternative pin assembly.
Figure 11B:
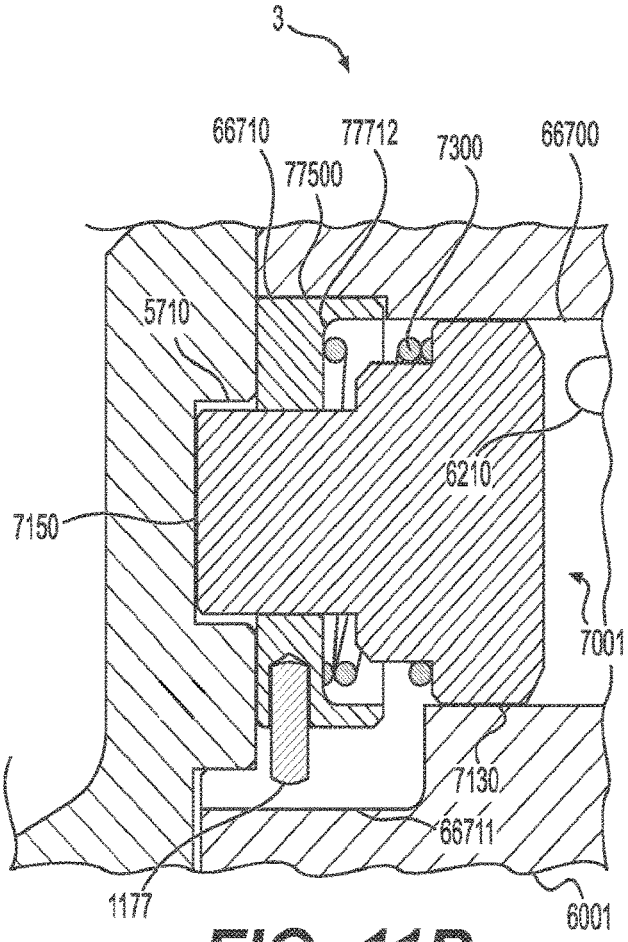

A lifter assembly 1, 2, 3 can be used in an engine between a cam rail and a valvetrain to lift and lower one or more valves of combustion cylinders according to the patterns formed on the cams 7 of the cam rail. A cam 7 is shown generally in FIGS. 1A & 1B. Lobes 31-33 impart lift profiles to the lifter assembly 1-3. If the lifter assembly, is latched (FIGS. 7 & 11; Right-hand of FIG. 1B; & bottom of FIG. 3), a first lift profile is imparted to one or more valves via the connection of push rod 4 to the valvetrain. If the lifter assembly is unlatched (FIGS. 6B & 6C; Left-hand of FIG. 1B and top of FIG. 3), a different lift profile is imparted to the one or more valves. Such variable valvetrain (VVA) techniques as engine braking (EB), cylinder deactivation (CDA), Late or Early valve closing or opening (LIVC, EIVC, LIVO, LEVO, EIVC, EIVO, EIVO, EEVO), and lost motions can be accomplished. In this disclosure, the latch pin assembly 70, 7000, 7001 is shown biased to the unlatched position, but the latch pin assembly can be biased to the latched position as by adjusting the springs and oil control.

A lifter assembly 1, 2, 3 can comprise an outer body 5, 5000 comprising an oil port 52, 5200 and opposed latch ports 571, 572, 5710, 5720. In lifter assembly 1, the opposed latch ports 571, 572 can be formed by tooling or cross-drilling, as examples. It would not be desired to have the inner body 6 rotate inside the outer body 5. In lifter assembly 2, 3, the opposed latch ports 5710, 5720 can be formed by a recess 5700 carved or tooled or cast in an inner diameter of the outer body 5000. In the lifter assembly 2, the inner body 6000 can rotate within the outer body 5000 because the latch ports in the recess 5700 can accommodate the rotation.

An inner body 6, 6000 can comprise a roller assembly 63 or tappet 6300 configured to lift and lower to follow the lobes 31-33 of cam 7. The inner body 6, 6000 comprises a pin passage 67, 6700, 66700 comprising an inner diameter. A pin assembly 70, 7000, 7001 is mounted in the pin passage 67, 6700, 66700. The pin assembly 70, 7000, 7001 comprises a bushing 75, 76, 7500, 7600, 77500 abutting the inner diameter. In lifter assembly 1, the inner diameter is largely cylindrical and the bushing 75, 76 is tubular and the bushing can be pressed or slipped inside the inner diameter. In lifter assembly 2, 3, the inner diameter is also largely cylindrical, but the inner diameter is stepped with steps 6710, 6720, 66710 at a junction of the external surface of the inner body. An outer surface 7715, 7725, 77715 of the bushing 7500, 7600, 77500 can be pressed to the steps 6710, 6720, 66710 of stepped inner diameter of inner body 6000, 6001. The inner body 6000 of lifter assembly 2 can comprise an additional anti-rotation step in addition to the step 66710 so that the bushing 7500 can comprise an anti-rotation notch 7717 to press to the stepped inner body.

The bushing 75, 76, 7500, 7600, 77500 is configured not to rotate and the pins 71, 72, 7100, 7200 can be configured not to rotate. This can improve the lifter assembly by reducing fluid pressure needed for actuation. And, the bushing can be used to support and align the pin. During use, the pins receive load, and the support and alignment provided by the bushing can improve load-bearing, prevent pin bending, and improve actuation response. Further, the bias springs 73, 74, 7300, 7400 can have reduced spring length and spring stress due to the support offered by the bushing. For switching the lifter assembly 1, 2, 3 between latched and unlatched, a fluid is supplied via oil supply 20 or gallery to outer body oil port 52, 5210, 5220 and inner body oil passages 621, 6210, 6220 to move the pins 71, 72, 7100, 7200. The bushing 75, 76, 7500, 7600, 77500 comprises a pin port 751, 7751, 77751. The pin 71, 72, 7100 comprises a rim 713, 723, 7130, 7240 and in some configurations a cup 724 to receive the supplied fluid. With appropriate fluid pressure, the pin can be moved. A narrow end 710, 7100 of the pin can be configured for sliding in the pin port 751, 7751, 77751. An optional spring-guiding lip 712, 7120 can also function as a travel stop to limit how far the pin can slide through the pin port. The pin port 751 can be formed in an end wall 750 of the bushing 75, 76 or the pin port 7751, 77751 can be stamped or molded or formed through the body of the bushing 7500, 77500.

The pin port 751, 7751, 77751 and the narrow end 710, 7100 are keyed in an anti-rotation configuration. This can mean that the narrow end 710 is cylindrical but for a flat 711 that slides against a corresponding flat in end wall 750. Or, two flats 7111, 7110 can be formed in the otherwise cylindrical narrow end 7100. These two flats 7111, 7110 on the pins can slide against corresponding flats 7711, 7713, 77711, 77713 in the pin port 7751, 77751 of the bushing 7500, 77500. Additional curves or other shapes can be formed on the end faces 715, 725, 7150, 7250 such as chamfers or rounding that prevents stiction, over-travel, or adhesion to the latch ports 5710, 5720, 571, 572.

In the pin assembly 70, the bushing 75, 76 comprises a step and a bore 753 in a tubular structure configured so that the rim 713 is guided within the bore 753 and is limited by the step. The step can be a part of the end wall 750 and the step can be comprised of the end wall 750 or a formation on the end wall. The bushing 75, 76 can be configured to seat a bias spring 73, 74 against the end wall 750 or the bushing 7500, 77500 can be configured to seat a bias spring 7300, 7400 against a spring rim 7712, 77712 in the body of the bushing. The bias springs 73, 74, 7300, 7400 can be seated against the end wall 750 or spring rim 7712, 77712, as appropriate, and can surround optional spring-guiding lip 712, 7120 with an abutment to rim 713, 723, 7130, 7240. It can be said that the bushing 75, 76, 7500, 77500 comprises an end wall comprising the pin port, wherein the end wall comprises a spring seating area such as the spring rim 7712, 77712 or a portion or formation on the end wall 750, and wherein the pin assembly further comprises a spring biased against the spring seating area and the rim 713, 723, 7130, 7240.

This configures the pins 71, 72, 7100 as normally-biased unlatched. The pin assembly 70, 7000, 7001 is biased so that the pins 71, 72, 7100 are retracted away from the latch ports 571, 572, 5710, 5720. It can be possible, as shown in the lifter assembly 1, to form the inner body 6 with a stop pin bore 693 intersecting the pin passage 67. A stop pin 93 can be placed in the stop pin bore 693 to limit the travel of the pins 71, 72. When pressurized fluid is supplied to the oil port 52 of the outer body 5, it is configured to fluidly communicate with an oil passage 621 in the inner body 6. The bushing can be configured with an oil slot 721 to fluidly communicate with the oil passage 621 to receive the pressurized fluid. Then, the pin 72 can be pushed to overcome the bias spring 74 to latch in the latch port 572. But without pressurized fluid, the bias spring 73 pushes the pin 71 out of the latch port 571 and into the inner body 6 so that the inner body can reciprocate within the outer body 5 according to the cam lobe profiles. To prevent the bias spring 73 from overcoming the bias spring 74, or vice versa, the stop pin 93 can be inserted. Then the rims 713, 723 abut the stop pin when biased to the unlatched or retracted pin assembly position. Overtravel of the pins 71, 72 is prevented. Stop pin slots 793 can be formed in the bushings 75, 76 to accommodate the stop pin 93. This can provide an anti-rotation feature to the bushings 75, 76.

An additional anti-rotation feature can be provided to the bushings 75, 76. An anti-rotation groove 791, 792 can be formed in an external diameter of the bushing 75, 76. Corresponding rod bores 691, 692 can be formed through the inner body 6 to intersect the pin passage 67. Anti-rotation rods 91, 92 can be seated in the anti-rotation grooves 791, 792 and the rod bores 691, 692 to prevent the bushings from rotating and altering the position of the flats 711 on the pins 71, 72. Force transfer to the flats 711 can be assured.

In additional aspects, pin support and anti-rotation of the pins 7100, 7200 can be shown. In FIGS. 6A-7 & 11B the rim 7130, 7240 slides against the inner body 6700. Pressurized fluid can be supplied to oil passage 6210 to push the pins 7100, 7200 apart as in FIGS. 7 & 11B. To return from the latched position to the unlatched position of FIGS. 6B & 6C, it can be beneficial to include an oil drain slot 66711 as a fluid leak-down path in addition to the step 66710. Bushing 77500 can comprise an anti-rotation stake 1177 pressed in the slot 77511 of the bushing and pressed into the drain slot 66711. Fluid pressure can be relieved while securing an anti-rotation function. The bias springs 7300, 7400 can assist with pushing the pressurized fluid out of the drain slot 66711 to return to the unlatched position.

Alternatively, the bushing 7500, 7600 can comprise an oil drain 7714, 7725 as a fluid leak-down path to alleviate the fluid pressure and return from a latched position to an unlatched position.

In yet another alternative, in the lifter assembly 1, the inner body 6 comprises a slot 611, 612. The bushing 75, 76 can comprise a recess 7511. The pin assembly 70 can then further comprise a corresponding stake 11, 12 spanning a portion of the slot 611, 612 and into the recess 7511. The stake 11, 12 can hold the pin port steady relative to the inner body 6. The stake 11, 12 can provide a flat against which the pin flat 711 slides. And, the stake 11, 12 can alternatively include a slot 111, 121 to provide a fluid leak-down path.

In another anti-rotation aspect, the lifter assembly 1 can comprise a follower anti-rotation bore 68 in the inner body 6. The outer body can comprise a follower anti-rotation slot 581. A follower anti-rotation rod 80 can be seated to extend out of the follower anti-rotation bore 68 into the follower anti-rotation slot 581. The follower anti-rotation bore can pass through the inner body 6 and the outer body 5 can comprise a second follower anti-rotation slot 582. The anti-rotation rod 80 can pass through the inner body 6 completely and extend out into both the follower anti-rotation slot 581 and the second follower anti-rotation slot 582. The anti-rotation rod 80 can assist with preventing the twisting of the bearing assembly 63 relative to the cam 7. The anti-rotation rod 80 can also provide a travel limit for restricting the motion of the inner body 6 relative to the outer body 5 as the anti-rotation rod 80 engages with the follower anti-rotation slot 581 and the second follower anti-rotation slot 582.

In an additional aspect, the bearing assembly 63 can be configured to prevent its twisting against the cam 7 by way of the bearing 633 bracing against the follower anti-rotation slot 581 and the second follower anti-rotation slot 582. Bearing 633 can rotate on an axle 632 supported in ports 631 of axle arms associated with the inner body 6. It is possible to form guide grooves on inner surfaces of tappet arms 531, 532 of the outer body 5. The axle 632 and bearing 633 can be guided against twisting relative to the outer body 5 thereby. Tappet arms 531, 532 can terminate in tappet surfaces 53 that slide on lobes 32, 33 of cam 7.

The latched or unlatched position of the latch assembly 70, 7000, 7001 can control what cam lobe profile is transferred through the inner body 6, 6000 to push rod seat 64, 6400 to push rod 4 and onward to an affiliated valvetrain. A bias assembly 44, 440 can comprise features such as springs, snap rings, spring seats, and the like to assist in the lifter assembly 1-3 following the cam 7.

While the disclosure has shown a lifter assembly, other hydro-mechanical latching mechanisms can benefit from the latch pin assemblies 70, 7000, 7001 herein. While the disclosure has omitted hydraulic lash adjusters (HLAs) from the lifter assemblies 1-3, it is possible to include HLAs with the anti-rotation and leak-down paths herein.

Other implementations will be apparent to those skilled in the art from consideration of the specification and practice of the examples disclosed herein.

What is claimed is:

1. A lifter assembly, comprising:

an outer body comprising an oil port and latch ports;

an inner body comprising a roller assembly or tappet configured to lift and lower to follow a cam, the inner body further comprising an oil passage fluidly communicating with a pin passage comprising an inner diameter; and a pin assembly mounted in the pin passage, the pin assembly comprising:

a bushing abutting the inner diameter, the bushing comprising a pin port having at least one flat portion; and a pin comprising a rim and a narrow end, the narrow end configured for sliding in the pin port and having at least one corresponding flat portion;

wherein the pin port and the narrow end are keyed in an anti-rotation configuration via the at least one flat portion of the pin port and the at least one corresponding flat portion of the narrow end, and wherein the bushing and the pin passage are keyed in an anti-rotation configuration.

2. The lifter assembly of claim 1, wherein the inner diameter is stepped and the bushing is pressed to the stepped inner diameter.

3. The lifter assembly of claim 2, wherein the rim slides against the inner diameter.

4. The lifter assembly of claim 1, wherein the inner body comprises a slot, and wherein the bushing comprises a recess, and wherein the pin assembly further comprises a stake spanning a portion of the slot and into the recess.

5. The lifter assembly of claim 4, wherein the stake comprises a fluid leak-down path.

6. The lifter assembly of claim 1, wherein the bushing further comprises a fluid leak-down path.

7. The lifter assembly of claim 1, wherein the bushing comprises a step and a bore in a tubular structure configured so that the rim is guided within the bore and is limited by the step.

8. The lifter assembly of claim 7, wherein the bushing comprises an end wall comprising the pin port, wherein the end wall comprises a spring seating area, and wherein the pin assembly further comprises a spring biased against the spring seating area and the rim.

9. The lifter assembly of claim 7, further comprising an anti-rotation groove in an external diameter of the bushing; a rod bore through the inner body and intersecting the pin passage; and an anti-rotation rod seated in the anti-rotation groove and in the rod bore.

10. The lifter assembly of claim 1, wherein the inner body further comprises a stop pin bore intersecting the pin passage, and wherein the lifter assembly further comprises a stop pin in the stop pin bore, the stop pin configured to limit a travel of the pin.

11. The lifter assembly of claim 1, wherein the inner body further comprises a follower anti-rotation bore, wherein the outer body further comprises a follower anti-rotation slot, and wherein the lifter assembly further comprises a follower anti-rotation rod seated to extend out of the follower anti-rotation bore into the follower anti-rotation slot.

12. The lifter assembly of claim 11, wherein the follower anti-rotation bore passes through the inner body, wherein the outer body comprises a second follower anti-rotation slot, and wherein the anti-rotation rod passes through the inner body completely and extends out into the second follower anti-rotation slot.

13. The lifter assembly of claim 1, wherein the bushing is configured with an oil slot to fluidly communicate with the oil passage.

14. The lifter assembly of claim 1, wherein the pin assembly is biased so that the pin is retracted away from the latch ports.

* * * * *